US007158093B2

(12) United States Patent
Yang et al.

(10) Patent No.: US 7,158,093 B2
(45) Date of Patent: Jan. 2, 2007

(54) QUADRI-FILAR HELIX ANTENNA STRUCTURE

(75) Inventors: Pei-Lin Yang, Hsinchu (TW); Chia-Chun Hung, Hsinchu (TW); Chun-Hao Chen, Hsinchu (TW); Ting-Chun Lee, Hsinchu (TW)

(73) Assignee: Jabil Circuit Taiwan Limited, Hsinchu (TW)

( * ) Notice: Subject to any disclaimer, the term of this patent is extended or adjusted under 35 U.S.C. 154(b) by 0 days.

(21) Appl. No.: 11/079,284

(22) Filed: Mar. 15, 2005

(65) Prior Publication Data

US 2006/0103586 A1 May 18, 2006

(30) Foreign Application Priority Data

Nov. 12, 2004 (TW) ..... 93134657 A

(51) Int. Cl.
*H01Q 1/36* (2006.01)

(52) U.S. Cl. ..... 343/895

(58) Field of Classification Search ..... 343/895, 343/821, 859, 700 MS, 702, 795
See application file for complete search history.

(56) References Cited

U.S. PATENT DOCUMENTS 2,258,776 A * 10/1941 Hommedieu et al. ..... 474/26
5,134,422 A * 7/1992 Auriol ..... 343/895
5,191,352 A * 3/1993 Branson ..... 343/895
5,793,338 A * 8/1998 Standke et al. ..... 343/895
5,986,616 A * 11/1999 Edvardsson ..... 343/853
6,184,845 B1 * 2/2001 Leisten et al. ..... 343/895
6,300,917 B1 * 10/2001 Leisten et al. ..... 343/895
6,424,316 B1 * 7/2002 Leisten ..... 343/895
2005/0035924 A1 * 2/2005 Liu et al. ..... 343/895
2005/0122265 A1 * 6/2005 Gaucher et al. ..... 343/700 MS

* cited by examiner

*Primary Examiner*—Trinh Dinh
*Assistant Examiner*—Huedung Mancuso
(74) *Attorney, Agent, or Firm*—Bacon & Thomas, PLLC

(57) ABSTRACT

The present invention discloses a quadri-filar helix antenna structure, which comprises a cylindrical body made of a dielectric material with a relative dielectric constant $\in_r$ greater than 4, and four radiating metal plates disposed on a distal end surface of the cylindrical body and extended along the radial direction of the center of the cylindrical body to its periphery and then along the radial direction in a spiral course on the circumferential surface thereof to its periphery on the other end respectively, wherein the ends of every two adjacent radiating metal plates are coupled with each other to constitute two sets of antenna structures, a penetrating hole is disposed at the central position of the cylindrical body and is precisely embedded into a coaxial cable, and a shield cable disposed at the periphery on one end of the coaxial cable is coupled to an end of another set of antenna structure. Therefore, the antenna not only reduces the overall volume, but also greatly lowers its production costs.

7 Claims, 6 Drawing Sheets

QUADRI-FILAR HELIX ANTENNA STRUCTURE

BACKGROUND OF THE INVENTION

1. Field of the Invention

The present invention relates to an antenna structure, more particularly to a quadri-filar helix antenna structure that can reduces the overall antenna size and greatly lowers its production and transportation costs.

2. Description of the Related Art

In recent years, as the wireless communication industry is blooming, the service of the satellite personal communication network (SPCN) available in the market gains more attentions, particularly the applications of handheld terminals (HHT). Therefore, people all over the world can communicate with each other by the handheld terminal through the satellite personal communication network, or the location of the handheld terminal holder can be located in a fast manner through the satellite personal communication network as to improve work efficiency and avoid unnecessary wastes of manpower, time and resources, and all these depends on the structure and design of the antenna of a handheld terminal.

Traditionally, an antenna used for receiving a satellite signal is usually deigned in a spiral structure. In other words, several radiating metal plates of the antenna are extended along a spiral path about the same axis to form a three-dimensional antenna. The antenna structure disclosed in the British Patent No. 2,258,776 belongs to this kind of antenna structure, and this patent makes use of a plurality of helical elements arranged around a common axis and extended along a spiral path to define a multiple-wire spiral antenna structure. Since such three-dimensional spiral antenna has an excellent receiving capability for the circularly polarized signals coming directly from the sky, and thus it is also called an antenna of the global positioning system (GPS) for receiving the coordinate positioning signals transmitted from a satellites group. In addition, the three-dimensional structure of this kind of antennas also fits an application as an omni-directional antenna for receiving vertically and horizontally polarized signals. However, one of the disadvantages of such three-dimensional antenna is that in certain applications, it is insufficiently robust, and cannot easily be modified to overcome this difficulty without a performance penalty.

In view of the shortcomings of the foregoing multiple-wire spiral antenna, many designs adopt a patch antenna such as the antenna installed on the outside of an aircraft fuselage for receiving the satellite signals under poor weather conditions. This kind of patch antennas comes with thin sheet radiating metal plates attached on an insulating material of the aircraft fuselage, but such patch antenna tends to have poor gain at low angles of elevation. With the efforts to overcome this disadvantage, antenna designers install a plurality of different batch antennas at different angles and different positions of the aircraft fuselage, and let the batch antennas be connected to the same receiver for receiving the satellite signals. This technique is expensive, not only due to the numbers of batch antennas required, but also due to the difficulty of combining the received signals and integrating all these batch antennas.

Please refer to FIG. 1 for the U.S. Pat. No. 6,424,316 issued to Leisten on Jul. 23, 2002, which effectively reduced the size of traditional quadri-filar antennas and designed a new quadri-filar antenna structure. The antenna comprises a cylindrical core 12 made of a ceramic material, four longitudinally extending antenna elements 10A, 10B, 10C, and 10D formed on a circumferential surface at an end proximate to the cylindrical core 12, and each antenna element 10A, 10B, 10C, and 10D is in the form of a metal plate, and a penetrating hole 14 is disposed along the radial direction of the center of the cylindrical core 12, and a metallic lining 16 is covered on the inner wall of the penetrating hole 14 and includes an insulator 17 inside. An axial feeder conductor 18 is installed at the central axis of the insulator 17, and a feeder structure is formed between the axial feeder conductor 18 and the metallic lining 16 to couple the feed line of a signal receiver (not shown in the figure) to each antenna element 10A, 10B, 10C, and 10D through the feed line.

The antenna structure further comprises a plurality of radial antenna elements 10AR, 10BR, 10CR, 10DR distributed on a surface at one end of the cylindrical core 12, and each radial antenna element 10AR, 10BR, 10CR, 10DR is substantially in the form of a metal plate being correspondingly and respectively coupled to one end of the antenna element 10A, 10B, 10C, 10D, such that one end of the antenna element 10A, 10B, 10C, 10D is coupled respectively with the feeder structure, and a common grounding conductor 20 is disposed on the circumferential surface at the other end proximate to the cylindrical body 12, and the common grounding conductor 20 is substantially in the shape of a circular ring being sheathed onto the circumferential surface at another end of the cylindrical body 12, and one end of the common grounding conductor 20 is coupled to another end of the antenna elements 10A, 10B, 10C, 10D, and the other end is extended to the surface of another end of the cylindrical body 12 to form a "sleeve balun" and coupled to the metallic lining 16.

Please refer to FIG. 1 for the structure of the antenna, wherein each antenna element 10A, 10B, 10C, 10D has a different length and a different shape, and any two of the antenna elements 10B, 10D are extended spirally along a meandering course on the circumferential surface of the cylindrical body 12, and thus its length is longer than the two antenna elements 10A, 10C that are extended spirally along a linear course on the circumferential surface of the cylindrical body 12.

From the issued patent of Leisten, it is known that the quadri-filar antenna uses a ceramic material with a high dielectric constant ($\in_r$=36) for the core, and the electrical length is a half loop and the four spiral antenna elements 10A, 10B, 10C, 10D have a half wavelength, and thus it can greatly reduce the overall size of the traditional quadri-filar antenna. However, the manufacturing process involved is more complicated and requires copper plating, lithography, etching and laser trimming processes. Particularly the height of the sleeve balun must be controlled to the micro level in order to eliminate the unbalanced current and thus greatly increasing the manufacturing time, manpower, and cost.

SUMMARY OF THE INVENTION

In view of the shortcomings of the prior art, the inventor of the present invention based on years of experience in the related field to conduct extensive research and development to overcome the foregoing shortcomings of the traditional quadri-filar antenna being too large and requiring a very complicated manufacturing process and find a solution for the improvement, and finally invented a quadri-filar helix antenna structure, and used a silkscreen printing method to effectively simplify the manufacturing process and reduce the time and manpower required for the manufacturing process and achieve the objectives of reducing the component size to make the antenna "light, thin, short and compact" as well as "good quality with a low price".

Therefore, it is one of the objectives of the present invention to provide a quadri-filar spiral antenna structure, which comprises a cylindrical body made of a dielectric material and four radiating metal plates disposed on a distal end surface of the cylindrical body, and each radiating metal plate is extended along the radial direction of the center of the cylindrical body to its periphery, and then extended along the radial direction in a spiral course on the circumferential surface of the cylindrical body to its periphery on the other end. On a distal end surface of the cylindrical body, the ends of every two adjacent radiating metal plates are coupled with each other to constitute two sets of antenna structures, and a penetrating hole is disposed at the central position of the cylindrical body, and the penetrating hole is precisely embedded into a coaxial cable, and a shield cable disposed at the periphery on one end of the coaxial cable is coupled to an end of another set of antenna structure. Therefore, the antenna so formed no longer requires the "Balun" but only uses the four radiating metal plates surrounding the cylindrical body to about a quarter of its wavelength for achieving the purpose of receiving satellite signals, not only reducing the overall antenna volume, but also greatly lowering its production and transportation costs.

Another objective of the present invention is to provide a quadri-filar helix antenna comprising a cylindrical body made of a dielectric material and four radiating metal plates disposed on a distal end surface of the cylindrical body, and each radiating metal plate is extended along the radial direction of the center of the cylindrical body to its periphery, and then extended along the radial direction in a spiral course on the circumferential surface of the cylindrical body to its periphery on the other end. On a distal end surface of the cylindrical body, the ends of every two adjacent radiating metal plates are coupled with each other to constitute two sets of antenna structures, and a penetrating hole is disposed at the central position of the cylindrical body, and a feeder conductor of the coaxial cable is coupled to one end of another set of antenna structure and passes through a through hole parallel to the penetrating hole and then connects to the shield cable at the periphery of an end of the coaxial cable to form a "folded balun". The antenna so formed also uses four radiating metal plates to surround the cylindrical body to about a quarter of the wavelength as to achieve the purpose of receiving satellite signals.

The above and other objects, features and advantages of the present invention will become apparent from the following detailed description taken with the accompanying drawings.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
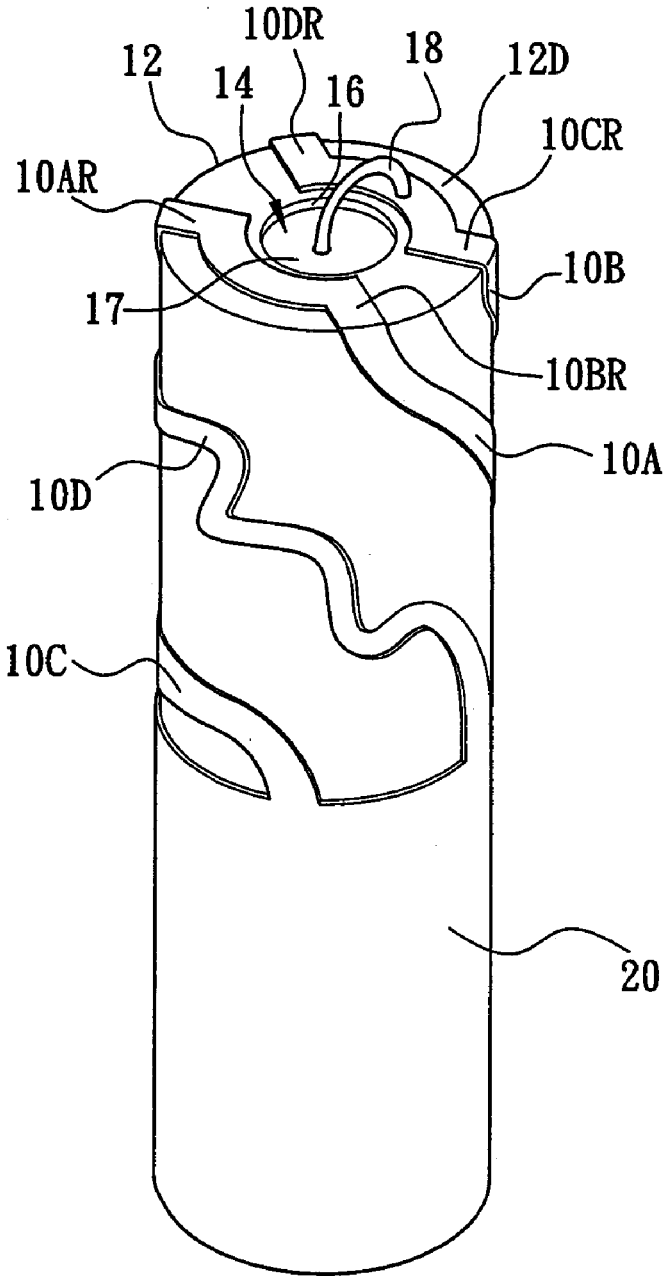
FIG. 1 is an illustrative view of the structure as described in the U.S. Pat. No. 6,424,316 issued to Leisten.
Figure 2:
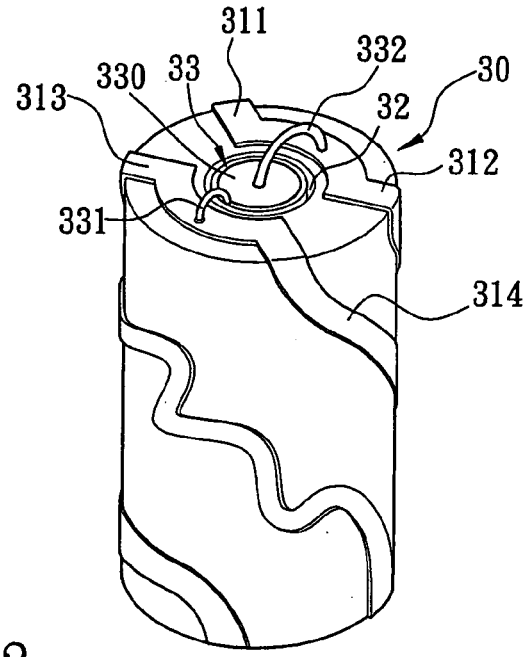
FIG. 2 is a perspective view of the quadri-filar helix antenna structure according to a preferred embodiment of the present invention.
Figure 4:
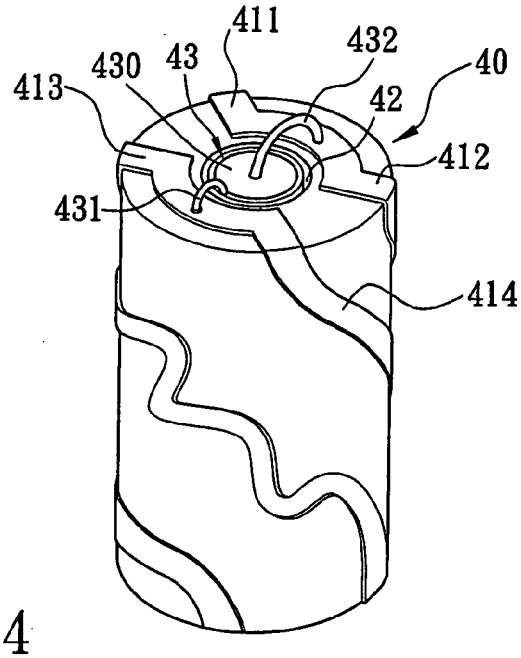
FIG. 4 is a perspective view of the quadri-filar helix antenna structure according to another preferred embodiment of the present invention.
Figure 6:
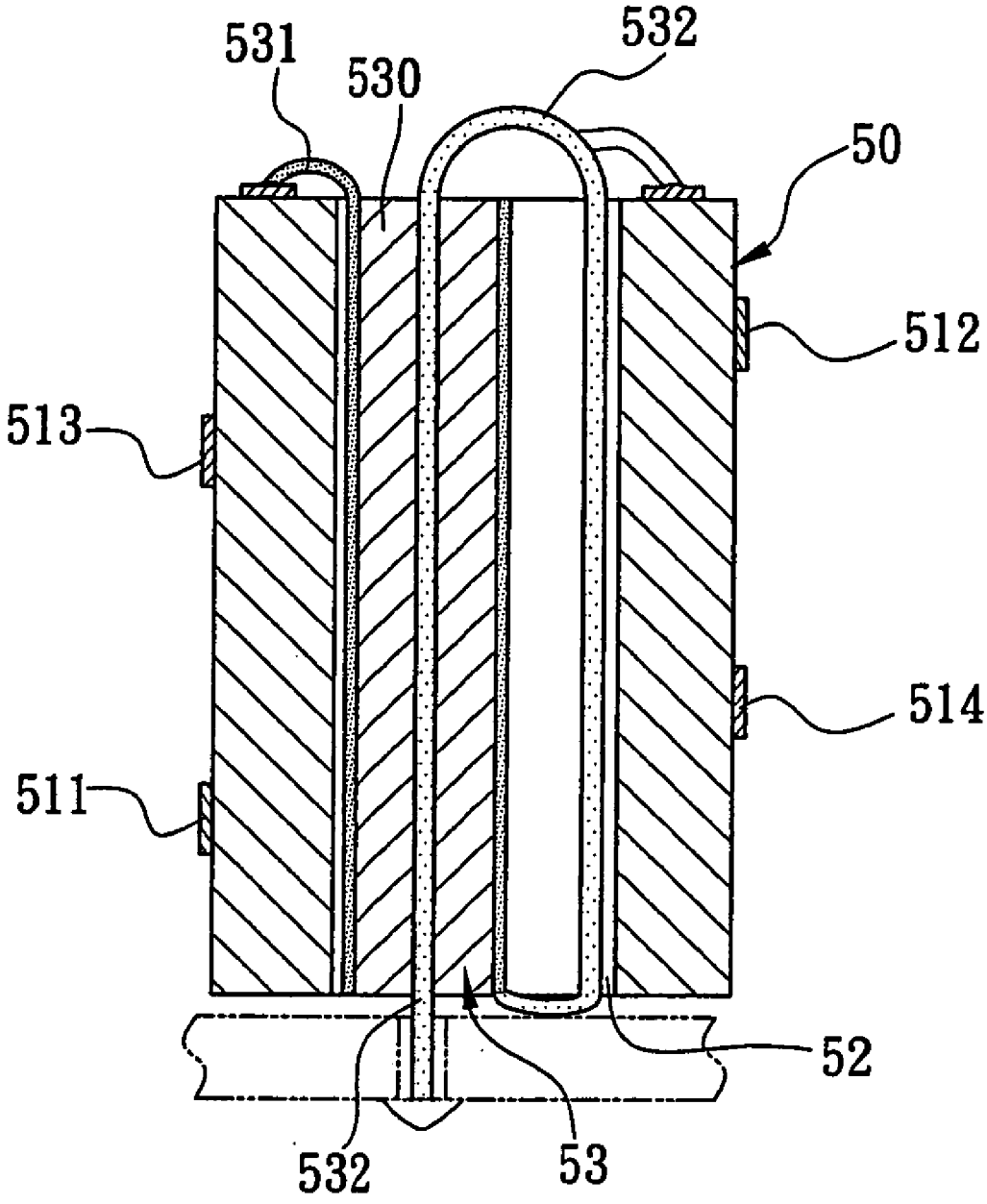
FIG. 6 is a sectional view of the quadri-filar helix antenna structure according to a further preferred embodiment of the present invention.

Please refer to FIGS. 2, 4 and 6 for a quadri-filar helix antenna structure in accordance with the present invention. The quadri-filar helix antenna structure comprises a cylindrical body 30, 40, 50 being made of a dielectric material (which could be a ceramic material or a polymer material), and four radiating metal plates 311, 312, 313 314, 411, 412, 413, 414, 511, 512, 513, 514 being disposed at a distal end surface of the cylindrical body 30, 40, 50, and each radiating metal plate 311, 312, 313 314, 411, 412, 413, 414, 511, 512, 513, 514 is extended along a radial direction of the center of the cylindrical body 30, 40, 50 to its periphery, and then extended along a spiral course on the circumferential surface of the cylindrical body 30, 40, 50 to the periphery of another end of the cylindrical body 30, 40, 50. On a distal end of the cylindrical body 30, 40, 50, the mutually facing ends of every two adjacent radiating metal plates 311 and 312, 313 and 314, 411 and 412, 413 and 414, 511 and 512, 513 and 514 are coupled with each other to form two sets of antenna structures, and another distal end surface of the cylindrical body 30, 40, 50 does not install any grounding metal plate. A penetrating hole 32, 42, 52 is disposed at the central position of the cylindrical body 30, 40, 50, and the penetrating hole 32, 42, 52 comprises an insulator 330, 430, 530 and the outer surface of the insulator 330, 430, 530 is covered by an electrically conductive shield layer (or a shield cable) 331, 431, 531. A feeder conductor 332, 432, 532 is disposed at the central position of the insulator 330, 430, 530, and two corresponding sides of the feeder conductor 332, 432, 532 are protruded from both ends of the penetrating hole 32, 42, 52 for passing the signals of the feeder conductor 332, 432, 532. When signals are transmitted through the coaxial cable 33, 43, 53, the signal is shielded by the electrically conductive shield layer 331, 431, 531 to prevent electromagnetic interference. Further, one end of the electrically conductive shield layer (or shield cable) 331, 431, 531 is coupled to one end of a set of antenna structures 313 and 314, 413 and 414, 513 and 514, and one end of the feeder conductor 332, 432, 532 is coupled to one end of another set of antennas structures 311 and 312, 411 and 412, 511 and 512. Another end of the feeder conductor 332, 432, 532 acts as a feed end of the quadri-filar helix antenna structure for receiving satellite signals and transmitting the signals to a receiver. Another end of the electrically conductive shield layer (or shield cable) 331, 431, 531 is coupled to the grounding terminal of the receiver.

Figure 3:
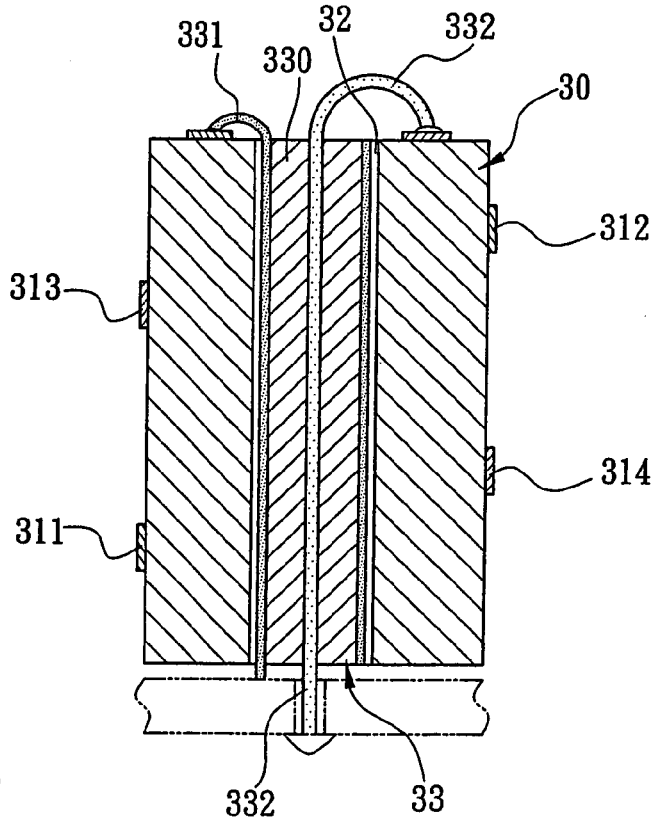
FIG. 3 is a sectional view of the quadri-filar helix antenna structure as depicted in FIG. 2.

Please refer to FIGS. 2 and 3 for another preferred embodiment of the present invention. One end of the electrically conductive shield layer (or shield cable) 331 of the coaxial cable 33 is coupled to one end of a set of antenna structure 313 and 314, and one end of the feeder conductor 332 is coupled to one end of another set of antenna structure 311 and 312, and another end of the feeder conductor 332 acts as a feed end of the quadri-filar helix antenna structure for receiving satellite signals and transmitting the signals to a receiver. Another end of the electrically conductive shield layer (or shield cable) 331 is coupled to a grounding terminal of the receiver as to from a quadri-filar helix antenna structure without using the so-called "Balun" as taught in the aforementioned U.S. Pat. No. 6,424,316, but only uses four radiating metal plates 311, 312, 313 with about a quarter of the wavelength of the cylindrical body 30 to achieve the purpose of receiving satellite signals, not only effectively reducing the overall size of the quadri-filar helix antenna structure, but also greatly lowering its production and transportation costs.

Figure 5:
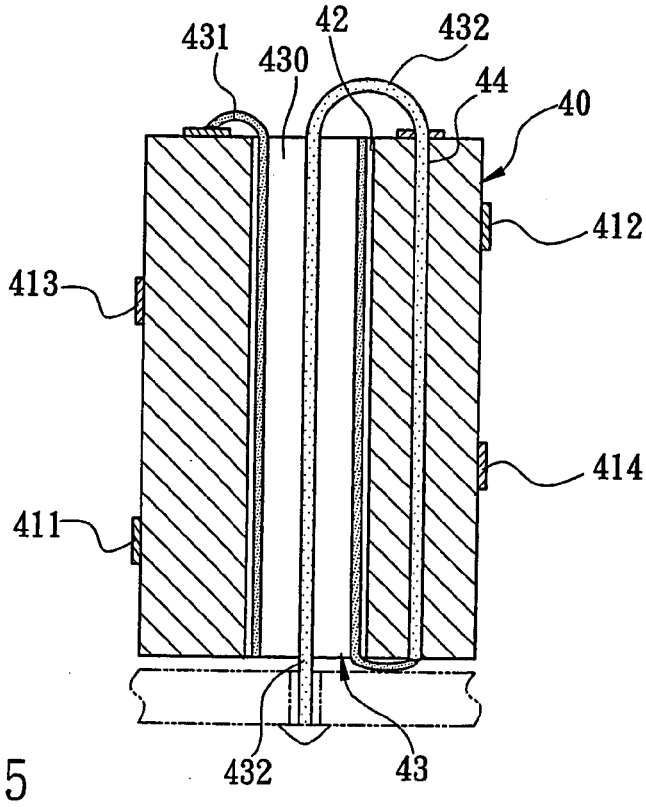
FIG. 5 is a sectional view of the quadri-filar helix antenna structure as depicted in FIG. 4.

Please refer to FIGS. 4 and 5 for another preferred embodiment of the present invention. One end of the electrically conductive shield layer (or shield cable) of the cylindrical body 40 is coupled to one end of a set of antenna structure 413 and 414 and one end of the feeder conductor 432 of the cylindrical body 40 is coupled to an end of another set of antenna structure 411 and 412. After one end of the feeder conductor 432 is coupled to another set of antenna structure 411 and 412 and passes through a through hole 44 parallel to the penetrating hole 42, and then is protruded from another end surface of the cylindrical body 40 and coupled to another end of the electrically conductive shield layer (or shield cable) to form a "folded balun" of the present invention, such that another end of the feeder conductor 432 acts as a feed end of the quadri-filar helix antenna structure, which only uses four radiating plates 411, 412, 413, 414 to surround about a quarter of the wavelength of the cylindrical body 40 as to achieve the purpose of receiving satellite signals.

It is noteworthy that another preferred embodiment of the present invention as shown in FIG. 6 omits the through hole 44 (as shown in FIGS. 4 and 5) as described in the foregoing embodiment, and only requires a connection of one end of the feeder conductor 532 to another set of antenna structure 511 and 512, and then passes through the penetrating hole 52 as to keep an insulation gap from the electrically conductive shield layer (or shield cable), and is coupled to another end of the electrically conductive shield layer (or shield cable) when being protruded from another end surface of the cylindrical body 50 to form a "folded balun".

Figure 7A:
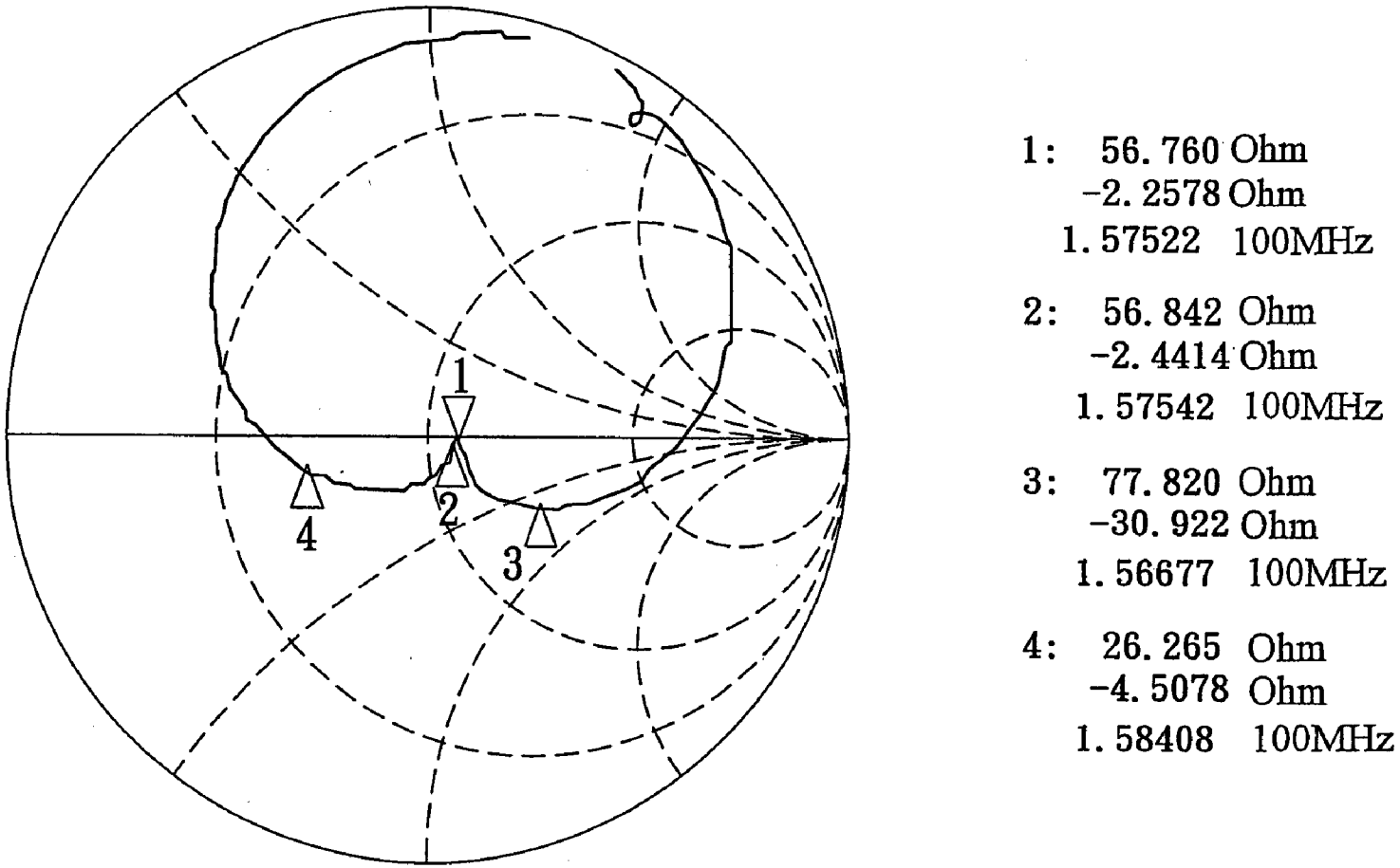
FIG. 7*a* is an illustrative view of the testing result of the quadri-filar helix antenna structure as depicted in FIG. 2.
Figure 7B:
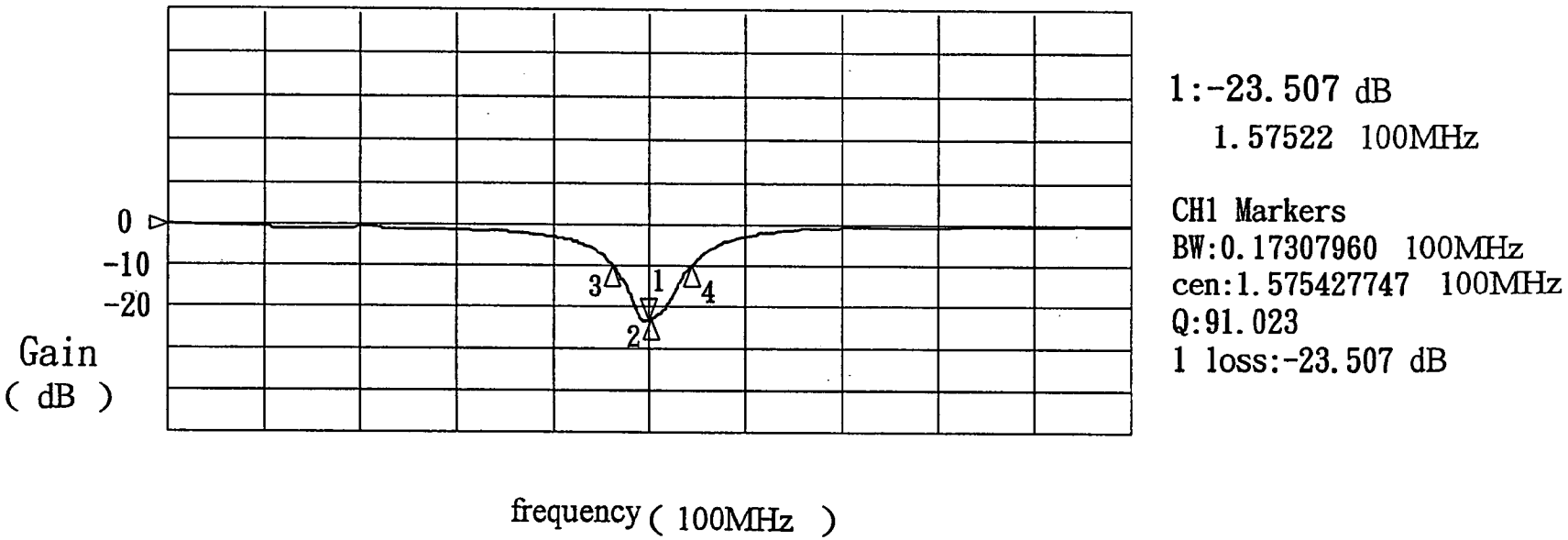
FIG. 7*b* is an illustrative view of another testing result of the quadri-filar helix antenna structure as depicted in FIG. 2.

In accordance with the design of the foregoing first preferred embodiment of the present invention, a quadri-filar helix antenna structure having a diameter of approximately 10 mm and a height of approximately 17 mm is made of a dielectric material with a relative dielectric $\in_r$ falling within the range $4<\epsilon_r<100$ in the GPS frequency, and its result after being tested is shown in FIGS. 7*a* and 7*b*. Compared with the traditional quadri-filar helix antenna, the size of the antenna structure using air as its dielectric base has a diameter of approximately 20 mm and a height of approximately 36 mm, and thus the quadri-filar helix antenna structure can reduce 90% of its volume.

Further, it is noteworthy that the quadri-filar helix antenna according to each of the foregoing preferred embodiments as shown in FIGS. 2, 4 and 6 comprises a radiating metal plate 311, 312, 313 314, 411, 412, 413, 414, 511, 512, 513, 514, and at least one radiating metal plate 312, 313, 412, 413, 512, 513 is extended in a meandering course from the periphery at one end of the cylindrical body 30, 40, 50 along the circumferential surface of the cylindrical body 30, 40, 50, which is substantially in a spiral shape until it is extended to the periphery of another end of the cylindrical body 30, 40, 50 as to precisely surround a the cylindrical body 30, 40, 50 up to bout a quarter of its wavelength. Further, the quadri-filar helix antenna structure comprises the plurality of radiating metal plates 311, 312, 313 314, 411, 412, 413, 414, 511, 512, 513, 514, and at least one radiating metal plate 311, 314, 411, 414, 511, 514 is extended in a meandering course from the periphery at one end of the cylindrical body 30, 40, 50 along the circumferential surface of the cylindrical body 30, 40, 50, which is substantially in a spiral shape until it is extended to the periphery of another end of the cylindrical body 30, 40, 50 as to precisely surround the cylindrical body 30, 40, 50 up to about a quarter of its wavelength.

The quadri-filar helix antenna structure in accordance with the present invention can omit the so-called "Balun" as adopted in the aforementioned U.S. Pat. No. 6,424,316 and thus the present invention not only effectively reduces the overall size of the quadri-filar helix antenna by providing a simple structure design, but also attaches each of the radiating metal plate onto the cylindrical body without requiring the process of copper plating, lithography, etching and laser trimming for manufacturing the required quadri-filar helix structure as to lower the manufacturing time, manpower, and cost.

In summation of the description above, the present invention is definitely a practical design and further complies with the patent application requirements and is submitted to the Patent and Trademark Office for review and granting of the commensurate patent rights.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A quadri-filar helix antenna, comprising:

a cylindrical body, being made of a dielectric material with a relative dielectric constant $\in_r$ greater than 4, and a penetrating hole disposed at its central position;

four radiating metal plates, and an end of said each radiating metal plate being disposed at an end surface of said cylindrical body and extended along the radial direction from the center of said cylindrical body to the periphery of said cylindrical body and then extended in a spiral course along the axial direction from the circumferential surface of said cylindrical body to the periphery at another end of said cylindrical body, and the facing ends of every two adjacent radiating metal plates disposed on one end surface of said cylindrical body being coupled with each other to constitute two sets of antenna structures;

a coaxial cable including an insulator, an electrically conductive shield layer covering said outer surface of the insulator, and a feeder conductor disposed at a central position within said insulator, said coaxial cable including said insulator, electrically conductive shield layer and said feeder conductor being embedded in said penetrating hole of the cylindrical body and both facing ends of said sets of antenna structures being protruded from both ends of said penetrating hole and one end of said electrically conductive shield layer being coupled to one end of one said set of antenna structures and one end of said feeder conductor being coupled to one end of another said set of antenna structures.

2. The quadri-filar helix antenna of claim 1, wherein said feeder conductor having one end coupled with said another said set of antenna structures passes through said penetrating hole and keeps an insulating gap from said electrically conductive shield layer and is coupled to another end of said electrically conductive shield layer when protruding from another end surface of said cylindrical body.

3. The quadri-filar helix antenna of claim 1 further comprising a through hole disposed on said cylindrical body at a position parallel to said penetrating hole for allowing an end of said feeder conductor to pass through after being coupled to one end of said another said set of antenna structure, and then is protruded from another end surface of said cylindrical body, and said electrically conductive shield layer being coupled to another end of said feeder conductor acting as a feed end of said antenna structure.

4. The quadri-filar helix antenna of claim 2, wherein said antenna structure has at least one of said radiating metal plates being extended spirally in a meandering course on a circumferential surface of said cylindrical body from a distal end surface of said cylindrical body to another distal end surface of said cylindrical body and surrounding said cylindrical body with a length substantially equal to a quarter of its wavelength.

5. The quadri-filar helix antenna of claim 3, wherein said antenna structure has at least one of said radiating metal plates being extended spirally in a meandering course on a circumferential surface of said cylindrical body from a distal end surface of said cylindrical body to another distal end surface of said cylindrical body and surrounding said cylindrical body with a length substantially equal to a quarter of its wavelength.

6. The quadri-filar helix antenna of claim 2, wherein said antenna structure has at least one of said radiating metal plates being extended spirally in a linear course on a circumferential surface of said cylindrical body from a distal end surface of said cylindrical body to another distal end surface of said cylindrical body and surrounding said cylindrical body with a length substantially equal to a quarter of its wavelength.

7. The quadri-filar helix antenna of claim 3, wherein said antenna structure has at least one of said radiating metal plates being extended spirally in a linear course on a circumferential surface of said cylindrical body from a distal end surface of said cylindrical body to another distal end surface of said cylindrical body and surrounding said cylindrical body with a length substantially equal to a quarter of its wavelength.

* * * * *